United States Patent [19]

Stewart

[11] Patent Number: 4,896,252

[45] Date of Patent: Jan. 23, 1990

[54] BOOKHOLDER

[76] Inventor: Richard M. Stewart, 236 Central Rd., Middlebury, Conn. 06762

[21] Appl. No.: 226,598

[22] Filed: Aug. 1, 1988

[51] Int. Cl.[4] ..... A47B 19/00

[52] U.S. Cl. ..... 362/98; 248/446; 248/461

[58] Field of Search ..... 362/98, 99; 248/447, 248/453, 461, 446, 449

[56] References Cited

U.S. PATENT DOCUMENTS

| | | | |
|---|---|---|---|
| 1,051,047 | 1/1913 | Wood | 248/447 |
| 3,884,538 | 5/1975 | Wise | 248/447 X |
| 3,991,967 | 11/1976 | Sack | 248/453 X |
| 4,021,013 | 5/1977 | Wiersina | 362/98 X |
| 4,093,326 | 6/1978 | Ford | 248/461 X |
| 4,191,354 | 3/1980 | Chia-Liu | 248/445 |
| 4,290,093 | 9/1981 | Thompson et al. | 362/98 |
| 4,323,214 | 4/1982 | DeLuen | 248/461 X |
| 4,553,728 | 11/1985 | Corsello | 248/452 |
| 4,700,634 | 10/1987 | Mills et al. | 362/98 X |

*Primary Examiner*—Ira S. Lazarus
*Assistant Examiner*—Peggy Neils
*Attorney, Agent, or Firm*—William C. Crutcher

[57] ABSTRACT

An improved bookholder consists of a box with a base and an opening at the top, a lid for the box which is pivotable from a first position extending in a substantially vertical direction above the base to a second position in which the lid covers the opening of the box, a pair of separately movable arms with ledges for supporting a book on the ledges when the lid is open, means for holding said book on the ledges and against the lid, the arms being arranged to be moved to a location on the lid where they will enter the opening of the box as the lid is pivoted to the second position. In its preferred form, the arms are attached to the lid to be pivotable, together with fixing means for holding them in selected positions, and are also hinged in the middle. An illuminating lamp is contained in the box, and arranged to illuminate the pages of the book.

9 Claims, 3 Drawing Sheets

BOOKHOLDER

BACKGROUND OF THE INVENTION

This invention relates generally to an improved bookholder which is portable and compact when it is not in use. More particularly, the invention relates to an improved bookholder, which is particularly useful for reading in bed at night from an inclined position, as well as adapted to other types of reading assistance, especially requiring illumination.

In my co-pending application, Ser, No. 000,221, filed Jan. 2, 1987, an improved bookholder was disclosed for inclined reading in bed wherein a support arm assembly, comprising arms disposed at right angles to one another and providing ledges for holding a book, was attached to a planar back wall. The back wall was supported from a base comprising an open box structure with an illuminating device inside.

Although the aforesaid bookholder successfully provided for illumination and inclined reading in bed, it would be desirable to provide an improved bookholder which presents a more tidy appearance when not in use. Also, the aforesaid previously described bookholder included means for holding a book in the horizontal position which raised it somewhat above the best position for proper illumination. Lastly, the support arm assembly in the aforesaid bookholder fixed the two arms together in a single assembly which somewhat limited its flexibility in providing multiple positions for holding the book.

Various bookholders have been suggested which are portable or which fold up when not in use. Examples are seen in U.S. Pat. No. 2,489,553—Wofford; U.S. Pat. No. 1,601,463—White et al.; U.S. Pat. No. 4,553,728—Corsello; U.S. Pat. No. 1,051,047—Wood; and U.S. Pat. No. 643,188—Hughes. Illuminating lamps have been suggested by U.S. Pat. No. 4,191,354—Chia Liu and others.

Accordingly, one object of the present invention is to provide an improved bookholder which is portable and can be folded away to provide a tidy appearance when not in use.

Another object of the invention is to provide an improved bookholder for holding a book in either inclined or horizontal positions, while illuminating the pages.

Yet another object of the invention is to provide improved means for pivotably attaching and securing the movable arms in a improved bookholder.

SUMMARY OF THE INVENTION

Briefly stated the invention is practiced by providing an improved bookholder consisting of a box with a base and an opening at the top, a lid for the box which is pivotable from a first position extending in a substantially vertical direction above the base to a second position in which the lid covers the opening of the box, a pair of separately movable arms with ledges for supporting a book on the ledges when the lid is open, means for holding said book on the ledges and against the lid, the arms being arranged to be moved to a location on the lid where they will enter the opening of the box as the lid is pivoted to the second position. In its preferred form, the arms are attached to the lid to be pivotable, together with fixing means for holding them in selected positions, and are also hinged in the middle. An illuminating lamp is contained in the box, and arranged to illuminate the pages of the book.

DRAWING

The subject matter which is regarded as the invention is particularly pointed out and distinctly claimed in the concluding portion of the specification. The invention, however, both as to organization and method of practice, together with further and advantages thereof, may best be understood by reference to the following description, taken in connection with the accompanying drawing, in which:

FIG. 1 is a perspective view of my improved bookholder with lid open and arms extended, FIG. 2 is a front elevation drawing, FIG. 3 is a end elevation in cross section, taken along the lines III—III of FIG. 1, FIG. 4 is the same cross section as FIG. 3, but with the lid closed, FIG. 5 is an enlarged fragmentary front elevation view of the left-hand arm illustrating the pivotable, FIGS. 6 and 7 are schematic cross-sectional views, taken along lines VI—VI and VII—VII of FIG. 2, illustrating preferred type of pivotable attachment and fixing means, and FIGS. 8 and 9 are views comparable to FIGS. 6 and 7 respectively, illustrating modified forms of pivoting attachment and fixing means for the arm.

DESCRIPTION OF THE PREFERRED EMBODIMENT

Figure 1:
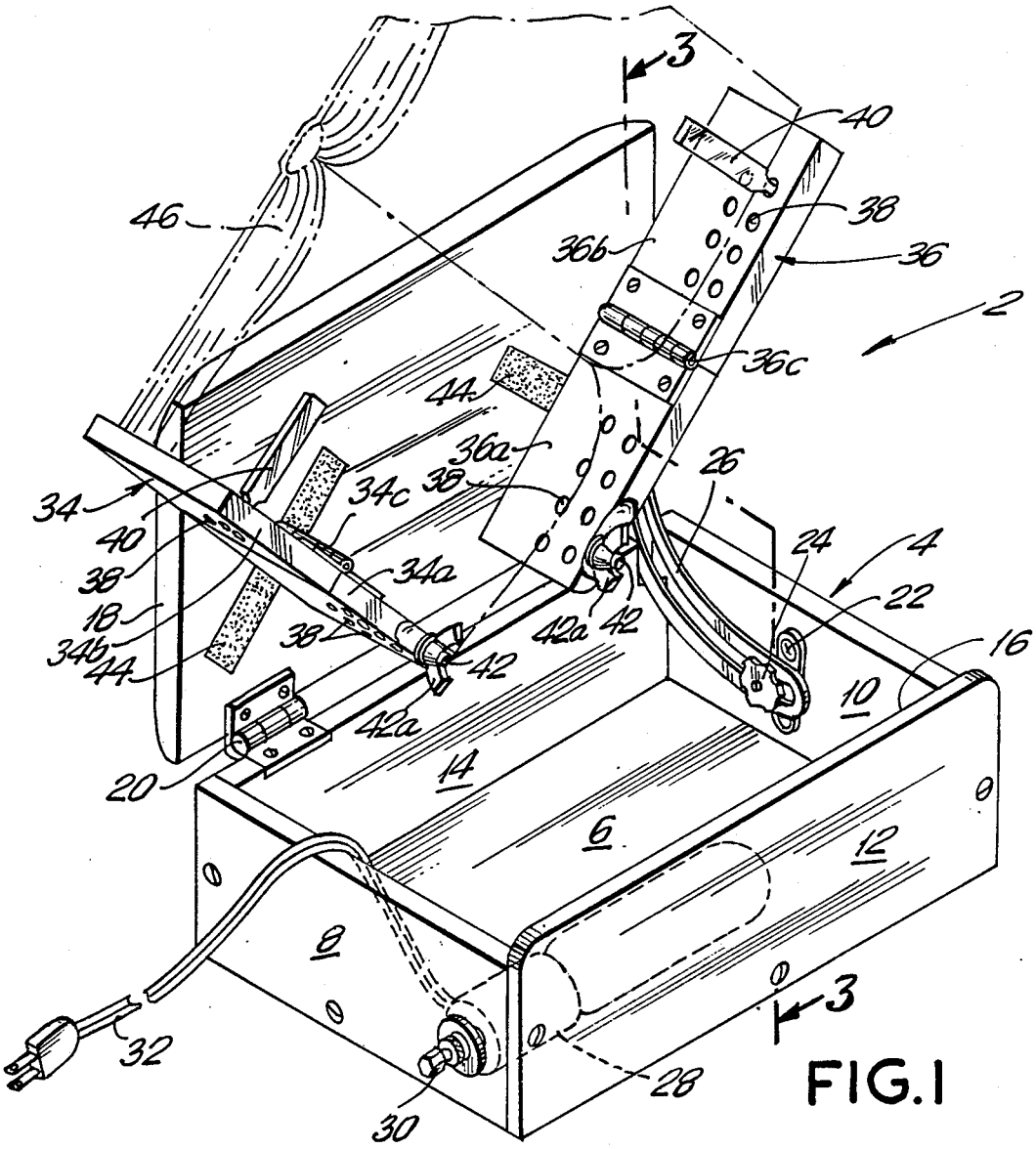

Referring to FIG. 1 of the drawing, the improved bookholder, shown generally at 2 comprises a box 4 having a base 6, side walls 8, 10, front wall 12 and back wall 14. The walls and base are attached together by screws and define a top opening 16 when the box 4 is resting on its base 6.

Bookholder 2 further comprises a lid 18 which is hinged to the backwall 14 of the box by hinges 20 so as to be pivotable thereon. A bracket 22 with thumb screw tightening device 24 cooperates with an arcuate slotted guide lever 26 which is pivotably attached to lid 18. Disposed in the box 4 is an illuminating lamp 28, having a switch 30 and power cord 32. The location of lamp 28 and the height of front wall 3 are selected such that the front wall acts as a shield between the reader's eyes and the light, while not blocking the view of the book.

In accordance with the present invention, a pair of separately movable arms 34, 36 are attached to underside of lid 18. Each of the arms 34, 36 is movable in two respects.

First, each arm consists of two sections attached by a hinge in the middle so that the arm is foldable. These parts for arm 34 are designated as inner arm member 34*a*, outer arm member 34*b*, and hinge 34*c*. Arm 36 contains similar elements: inner arm 36*a*, outer arm 36*b*, and hinge 36*c*.

The respective arms 34, 36 provide ledges thereon which extend from the inside surface of lid 18. Furthermore they are provided with means for holding the book on the ledges and holding the pages of a book. Such holding means comprise a series of drilled holes 38 in the arms and transparent flat pegs 40, which may be positioned in appropriately selected holes 38.

The pair of arms 34, 36 are also separately movable by means of pivotable connections at the lowermost end of each inner arm, comprising a threaded shaft 42 with thumb screw 42*a* secured to the underside of lid 18.

Means for fixing the position of arms 34, 36 at a desired angular position with respect to lid 18 comprise strips 44 roughened or gritty surface secured by adhesive to the underside of lid 18 and facing the edge of inner arms 34a, 36a.

Pivotable attachment 42, together with fixing means 44 enable positioning arms 34, 36 at 45 degrees to the lid as shown in FIG. 1, so as to hold a book indicated by phantom lines 46, in the proper 45 degree positions for inclined reading in bed at night, as previously suggested in connection with my aforesaid pending patent application, Ser. No. 000,221.

Figure 2:
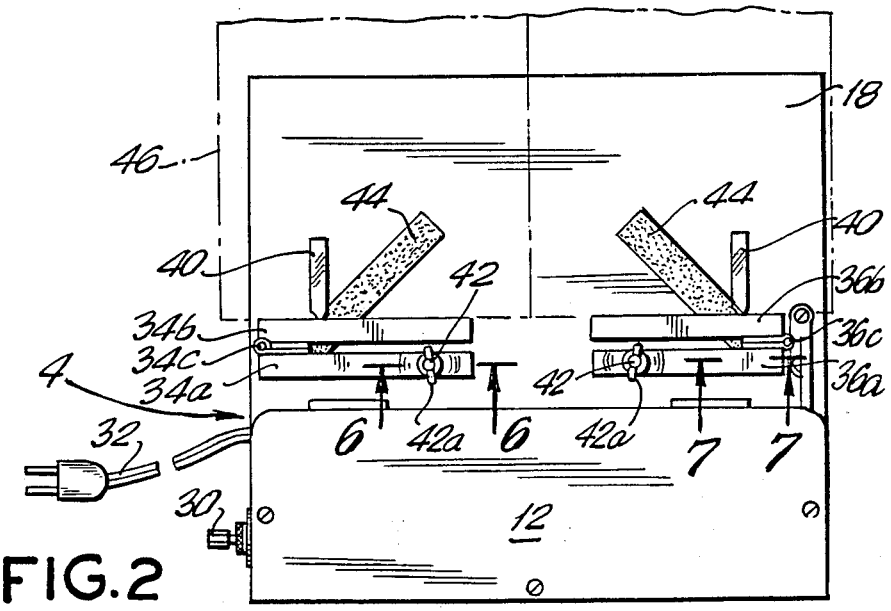

Referring now to FIG. 2 of the drawing, the front elevation view illustrates the arms 34, 36 with the inner arms folded together against the outer arms. In addition, the inner arms have been pivoted on the pivotable connections 42, so that a pair of ledges are aligned in a substantially horizontal orientation. The book 46 is shown positioned on the bottom side of outer arms 34b, 36b and held by pegs 40 as before.

Figure 3:
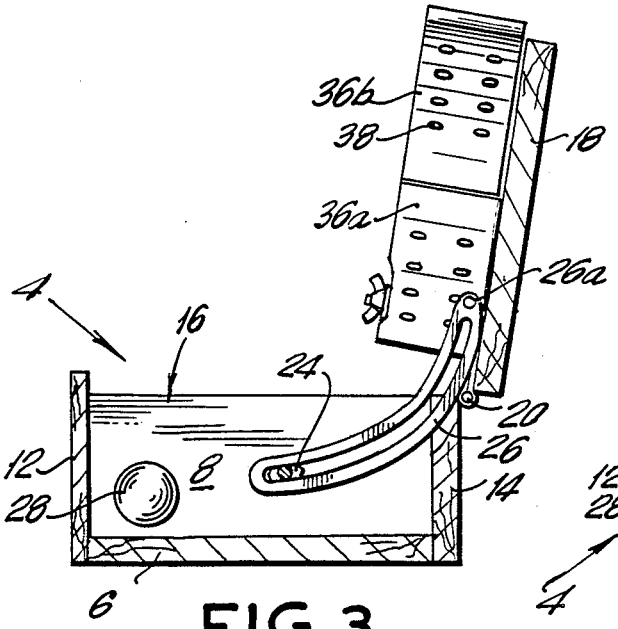

Referring to FIG. 3 of the drawing, lid 18 is shown pivoted to a first or substantially vertical position with respect to box 4 when the box is resting on its base 6, the lid being limited in movement to this position by the grooved lever 26. FIG. 3 illustrates that lever 26 is connected to lid 18 at 26a. By "substantially vertical," it is understood that slight variation from vertical is included, the preferred position being slightly inclined to the rear. Arms 36a, 36b are extended to a position for holding the book as in FIG. 1. As seen in FIG. 1, the extended position of the arms would actually interfere with closing the lid 18.

Figure 4:
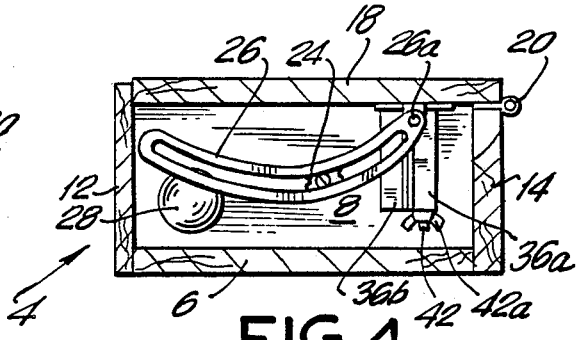

Referring to FIG. 4 of the drawing, outer arm 36b has been folded on hinge 36c to a position which does not interfere with closure of lid 18 to a second position which covers the opening 16 of box 4. It will be understood that shorter u hinged arms may also be used, which may be moved to a non-interfering position by pivoting on connections 42.

Figure 5:
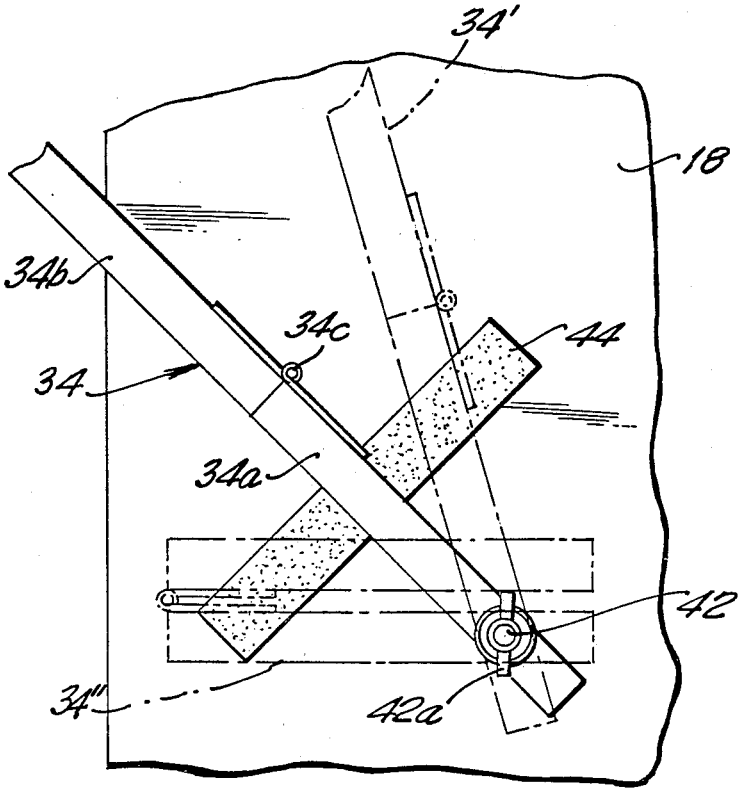

Reference to FIG. 5 of the drawing illustrates movable arm 34 in more detail, the other arm being substantially identical in construction.

First, the pivotable connection 42 permits pivoting of the entire arm 34 to any desired angular position, such as 34', where it is locked in position by tightening thumb screw 42a to squeeze arm 34 against the roughened surface of strip 44, the latter fixing it in position. Such pivotable motion of arm 34 can be coordinated with similar adjustment of arm 36 to slightly adjust the position of the book, keeping the arms at right angles to one another.

Secondly, arm 34b may be folded on hinge 34c into a non-interfering location on lid 18, whereby the lid may be closed with the folded arms 34, 36 entering the top opening of the box, at the same time avoiding the illuminating lamp 28 inside of the box.

Lastly, the hinged and pivoting motions may be coordinated with one another as shown by the phantom line positions 34''. This allows holding the book in a horizontal Position as indicated in FIG. 2.

Figure 6:
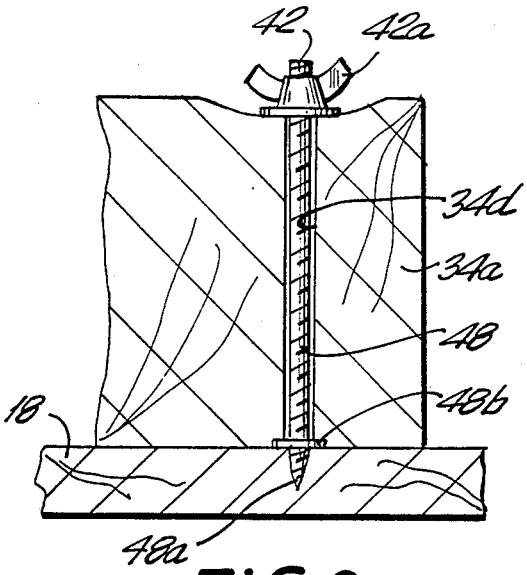
Figure 7:
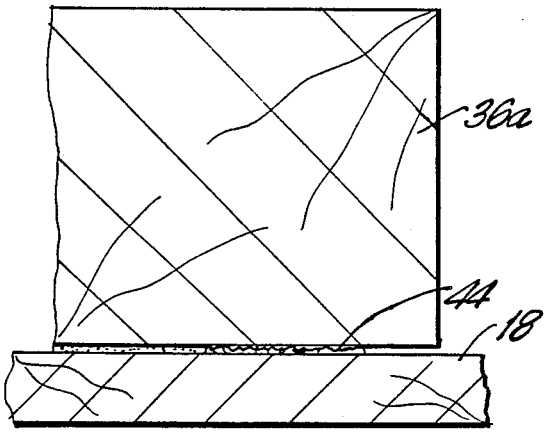

The cross-sectional views of FIGS. 6 and 7 illustrate in more detail a preferred means of pivoting and fixing arms 34, 36 on lid 18.

FIG. 6 shows a type of pivotable connection which does not require piercing the outside surface of lid 18. A shaft 48 threaded to receive thumb screw 42a, is provided with a point 48a having screw threads thereon and a washer stop 48b. Shaft 48 passes through a hole 34d near the lower end of inner arm 34a.

Means for fixing the arm include the roughened strip 44, which may consist of commercially available abrasive strip having a large grit size and attached by adhesive on its back. When the thumb screws are tightened against the inner arms, in this case inner arm 36a, the arm is squeezed tightly upon the roughened surface of strip 44 which fixes the arm securely in place.

Figure 8:
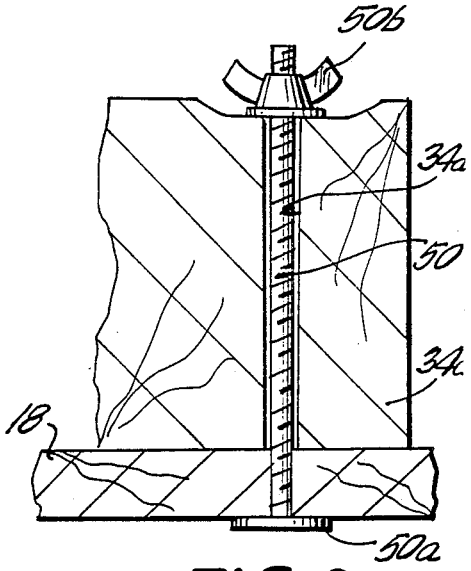

Referring to FIG. 8, a modified pivotable attachment is shown consisting of a shaft 50 with head 50a and thumb screw 50b passing through a similar hole 34d in inner arm 34a. This may be substituted for the pivotable attachment shown in FIG. 6.

Figure 9:
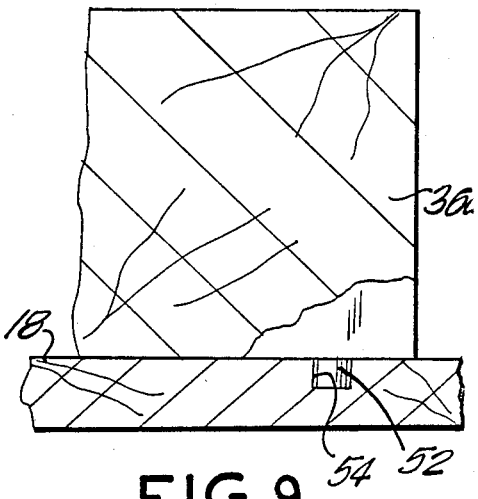

Reference to FIG. 9 shows an alternate type of fixing means, which may be used in lieu of the roughened strip 44. A peg 52 attached to arm 36a extends into a suitably disposed hole 54 in lid 18. A series of such holes 54 are drilled on an arc centered on the pivotable connection. The fixing means cf FIG. 9 may be used with either of the pivotable attachments of FIGS. 6 or 8.

OPERATION OF THE INVENTION

When the improved bookholder is not in use, the movable arms 34, 36 are folded and pivotably moved to a non-interfering location on lid 18. At this time, the lid 18 can be closed with the power cord 32 stored inside the box 4 along with the arms 34, 36.

In use, the lid 18 is opened to a substantially vertical position and arms extended and pivoted to the FIG. 1 position for holding a book for an inclined reader, or alternatively pivoted to a horizontal alignment as shown in FIG. 2. The illuminating lamp inside box 4 directs the light towards the pages, while the walls, especially the front wall 12 of the box, shields the light from the reader's eyes without blocking the view of the book.

While the improved bookholder is portable and therefore can be placed upon a bedside stand of any suitable height to suit the reader, the invention is not restricted to use on a table, but may easily be provided with an attached tripod or adapted for self-contained folding or telescoping legs without departing from the spirit of the invention.

While there has been disclosed what is considered to be the preferred embodiment of the invention, it is desired to cover in the appended claims all such modifications as fall within the true spirit and scope of the invention.

I claim:

1. An improved bookholder comprising;

a box having a base and defining a top opening, a lid for said box adapted to be pivotable thereon from a first position extending in a substantially vertical direction from said base to a second position in which said lid covers said top opening, said lid having a flat inside surface directed toward said top opening, a pair of movable arms defining ledges thereon, said arms being attached to said flat inside surface of said lid and adapted to support a book on said ledges when the lid is in said first position, means for holding said book on the ledges and against said lid, said arms being arranged for pivoting movement in a plane parallel to said lid to a non-interfering location where they will enter the top opening of said box as the lid is pivoted to said second position, wherein said arms are pivotably connected by pivot pins normal to said lid, and further including means for fixing said arms when they are pivoted to a selected location on said lid.

2. The combination according to claim 1, wherein each of said arms comprises an inner arm pivotably connected to said lid, and an outer arm hinged thereto, said inner and outer arm being foldable to said non-interfering location on the lid.

3. The combination according to claim 1, wherein each of said arms comprises an inner arm hinged to an outer arm, and wherein said inner arms are pivotably connected to said lid on the end thereof opposite said hinged connection.

4. The combination according to claim 1, wherein said open box includes an illuminating device disposed inside said opening and arranged to illuminate the pages of said book when it is held on said ledges.

5. The combination according to claim 1, wherein each of said arms is separately pivotably connected to said lid.

6. The combination according to claim 1, wherein said threaded shaft includes a wood screw Point and having a washer spaced to allow the point to penetrate, but not pierce, said lid.

7. The combination according to claim 1, wherein said fixing means include an abrasive strip disposed between said lid and said arm.

8. The combination according to claim 4, wherein said box includes a front wall of sufficient height to shield a reader's eyes from said illuminating device, but not high enough to block a reader's eyes from said book.

9. An improved bookholder comprising;

a box having a base and defining a top opening, a lid for said box adapted to be pivotable thereon from a first position extending in a substantially vertical direction from said base to a second position in which said lid covers said top opening, said lid having a flat inside surface directed toward said top opening, a pair of movable arms defining ledges thereon, said arms being attached to said flat inside surface of said lid and adapted to support a book on said ledges when the lid is in said first position, means for holding said book on the ledges and against said lid, said arms being arranged for pivoting movement in a plane parallel to said lid to a non-interfering location where they will enter the top opening of said box as the lid is pivoted to said second position, wherein said arms are pivotably connected by pivot pins normal to said lid in a pivotable connection comprising a threaded shaft passing through an arm into said lid, and further including means for fixing said arms when they are pivoted to a selected location on said lid, wherein said fixing means comprise thumb screw means on said threaded shaft adapted to tighten said arm against said lid.

* * * * *